US009959820B2

(12) United States Patent
Wang et al.

(10) Patent No.: US 9,959,820 B2
(45) Date of Patent: May 1, 2018

(54) ARRAY SUBSTRATE, DISPLAY DEVICE AND IMAGE DISPLAY METHOD

(71) Applicants: BOE TECHNOLOGY GROUP CO., LTD., Beijing (CN); BEIJING BOE OPTOELECTRONICS TECHNOLOGY CO., LTD., Beijing (CN)

(72) Inventors: Kaixuan Wang, Beijing (CN); Wei Li, Beijing (CN); Hongliang Yuan, Beijing (CN); Jiantao Liu, Beijing (CN); Yingzi Wang, Beijing (CN); Zhenfu Ma, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 63 days.

(21) Appl. No.: 15/085,609

(22) Filed: Mar. 30, 2016

(65) Prior Publication Data

US 2016/0307525 A1 Oct. 20, 2016

(30) Foreign Application Priority Data

Apr. 20, 2015 (CN) ..... 2015 1 0187830

(51) Int. Cl.
*G09G 3/36* (2006.01)

(52) U.S. Cl.
CPC ... *G09G 3/3607* (2013.01); *G09G 2300/0426* (2013.01); *G09G 2300/0452* (2013.01);
(Continued)

(58) Field of Classification Search
CPC .... G06F 1/1616; G06F 1/1626; G06F 1/1681; G06F 1/182; G06F 1/26
See application file for complete search history.

(56) References Cited

U.S. PATENT DOCUMENTS

2003/0123013 A1* 7/2003 Han ..... G02F 1/13452 349/149
2006/0081850 A1* 4/2006 Lee ..... G02F 1/136286 257/72

(Continued)

FOREIGN PATENT DOCUMENTS

CN 104483794 * 1/2015 ..... G02F 1/133

*Primary Examiner* — Olga Merkoulova
(74) *Attorney, Agent, or Firm* — Harness, Dickey & Pierce, P.L.C.

(57) ABSTRACT

An array substrate, display device and image display method. In this array substrate, among the sub-pixels two adjacent columns of sub-pixels are grouped together, and sub-pixels in different groups do not overlap each other; in each group, all of the sub-pixels are electrically connected with a same data line; each row of the sub-pixels corresponds to two gate lines, and in each row of the sub-pixels, two sub-pixels belonging to the same group are electrically connected with one of the two gate lines corresponding to this row of the sub-pixels respectively; thus, in the process of sequentially loading a gate scanning signal to each grid line within the display time of one frame, charging difference between rows of sub-pixels caused by the jump of voltage loaded on the data line may be reduced, whereby poor stripes present when a flat panel display is displaying a screen may be improved.

20 Claims, 11 Drawing Sheets

(52) U.S. Cl.
CPC ..... *G09G 2320/0233* (2013.01); *G09G 2320/0242* (2013.01)

(56) References Cited

U.S. PATENT DOCUMENTS

| | | | | |
|---|---|---|---|---|
| 2007/0279344 | A1* | 12/2007 | Kimura | G09G 3/2022 345/77 |
| 2008/0165102 | A1* | 7/2008 | Tsai | G09G 3/3413 345/88 |
| 2010/0002021 | A1* | 1/2010 | Hashimoto | G09G 3/2003 345/690 |
| 2010/0109994 | A1* | 5/2010 | Lee | G02F 1/136286 345/98 |
| 2011/0102309 | A1* | 5/2011 | Cho | G09G 3/3648 345/92 |
| 2014/0266995 | A1* | 9/2014 | Cho | G09G 3/3607 345/88 |
| 2016/0233234 | A1* | 8/2016 | Yang | G02F 1/136286 |
| 2017/0301696 | A1* | 10/2017 | Yang | H01L 27/124 |

* cited by examiner 1
2
3
4
R
G
B
R
G
B
B
R
G bright
B
R
G bright
G bright
B
R
G bright
B
R
G bright
B
R

ARRAY SUBSTRATE, DISPLAY DEVICE AND IMAGE DISPLAY METHOD

CROSS-REFERENCE TO RELATED APPLICATION

This application claims the benefit and priority of Chinese Patent Application No. 201510187830.4 filed Apr. 20, 2015. The entire disclosure of the above application is incorporated herein by reference.

FIELD

The present disclosure relates to the display technical field, and particularly, to an array substrate, display device and image display method.

BACKGROUND

This section provides background information related to the present disclosure which is not necessarily prior art.

With the continuous development of display technology, Organic Light Emitting Diode (OLED), Plasma Display Panel (PDP) and Liquid Crystal Display (LCD) and other flat panel display are developed rapidly.

Taking existing LCD as an example, on the array substrate side in the existing LCD, as shown in FIG. 1, there are generally provided a plurality of gate lines 101 and a plurality of data lines 102 intersected and insulated one another, as well as a plurality of sub-pixels sub-pixels, where I, II, III may represent any one of red color (R), green color (G) and blue color (B). As shown in FIG. 1, in each column of sub-pixels, every two adjacent sub-pixels have different resistance color, and in a case where gray scales of I, II, III in one frame of display screen are different, in the process of sequentially loading a gate scanning signal to each grid line 101 within display time of one frame, voltage loaded on the data line 102 will have a jump. When the voltage loaded on the data line 102 has a jump, since the data line 102 itself has certain resistance, the charging of each row of sub-pixels by the voltage loaded on the data line 102 may differ, thereby resulting in difference in display luminance between rows of sub-pixels, and further leading to the presence of seriously poor stripes when a flat panel display is displaying a screen.

Therefore, how to improve the presence of poor stripes in a flat panel display is a technical problem those skilled in the art need to solve.

SUMMARY

This section provides a general summary of the disclosure, and is not a comprehensive disclosure of its full scope or all of its features.

Embodiments of the present invention provide a substrate array, display device and image display method, for the presence of flat panel displays to improve the presence of poor stripes in a flat panel display.

Therefore, embodiments of the present disclosure provide an array substrate, comprising: a base substrate and a plurality of sub-pixel units arranged in matrix on the base substrate; each of the sub-pixel units is composed of four rows and three columns of sub-pixels; in each of the sub-pixel units, the first row is a first sub-pixel, a second sub-pixel and a third sub-pixel sequentially, the second row is a third sub-pixel, a first sub-pixel and a second sub-pixel sequentially, the third row is a second sub-pixel, a third sub-pixel and a first sub-pixel sequentially, the fourth row of sub-pixels are the same as the second row of sub-pixels; the first sub-pixel, the second sub-pixel and the third sub-pixel have resistance colors different from each other; further comprising: a plurality of gate lines and a plurality of data lines located on the base substrate, intersected and insulated one another;

among the sub-pixels two adjacent columns of sub-pixels are grouped together, and sub-pixels in different groups do not overlap each other; in each group, all of the sub-pixels are electrically connected with a same data line; each row of the sub-pixels corresponds to two gate lines, and in each row of the sub-pixels, two sub-pixels belonging to the same group are electrically connected with one of the two gate lines corresponding to this row of the sub-pixels respectively.

In one possible implementation, in the array substrate provided in the embodiments of the present disclosure, in each row of the sub-pixels, odd columns of sub-pixels are electrically connected with gate lines above this row of the sub-pixels, and even columns of sub-pixels are electrically connected with gate lines below this row of the sub-pixels; or in each row of the sub-pixels, even columns of sub-pixels are electrically connected with gate lines above this row of the sub-pixels, and odd columns of sub-pixels are electrically connected with gate lines below this row of the sub-pixels.

Embodiments of the present disclosure further provide a display device comprising the array substrate provided in the embodiments of the present disclosure.

With respect to the display device provided in the embodiments of the present disclosure, the embodiments of the present disclosure further provide an image display method, comprising:

when displaying one frame of image, loading a gray scale signal for each of the sub-pixels, so that each of the first sub-pixels displays a first gray scale, each of the second sub-pixels displays a second gray scale, and each of the third sub-pixels displays a third gray scale; wherein, the first gray scale, the second gray scale and the third gray scale are mutually different.

In one possible implementation, in the abovementioned method provided in the embodiments of the present disclosure, when the resistance color of the first sub-pixels is green, in one frame of display image, the first gray scale is less than the second gray scale, and greater than the third gray scale.

In one possible implementation, in the abovementioned method provided in the embodiments of the present disclosure, in one frame of display image, the first gray scale is 127, the second gray scale is 255, and the third gray scale is 0.

In one possible implementation, in the abovementioned method provided in the embodiments of the present disclosure, when the resistance color of the second sub-pixels is green, in one frame of display image, the second gray scale is greater than the first gray scale, and less than the third gray scale.

In one possible implementation, in the abovementioned method provided in the embodiments of the present disclosure, in one frame of display image, the first gray scale is 0, the second gray scale is 127, and the third gray scale is 255.

In one possible implementation, in the abovementioned method provided in the embodiments of the present disclosure, when the resistance color of the third sub-pixels is green, in one frame of display image, the third gray scale is less than the first gray scale, and greater than the second gray scale.

In one possible implementation, in the abovementioned method provided in the embodiments of the present disclosure, in one frame of display image, the first gray scale is 255, the second gray scale is 0, and the third gray scale is 127.

Embodiments of the disclosure further provide an array substrate, comprising: a base substrate and a plurality of sub-pixel units arranged in matrix on the base substrate; each of the sub-pixel units is composed of six rows and four columns of sub-pixels; in each of the sub-pixel units, the first row is a first sub-pixel, a second sub-pixel, a third sub-pixel and a fourth sub-pixel sequentially, the second row is a fourth sub-pixel, a first sub-pixel, a second sub-pixel and a third sub-pixel sequentially, the third row is a third sub-pixel, a fourth sub-pixel, a first sub-pixel and a second sub-pixel sequentially, the fourth row is a second sub-pixel, a third sub-pixel, a fourth sub-pixel and a first sub-pixel sequentially, the fifth row of sub-pixels are the same as the third row of sub-pixels, and the sixth row of sub-pixels are the same as the second row of sub-pixels; the first sub-pixel, the second sub-pixel, the third sub-pixel and the fourth sub-pixel have resistance colors different from each other; further comprising: a plurality of gate lines and a plurality of data lines located on the base substrate, intersected and insulated one another;

among the sub-pixels two adjacent columns of sub-pixels are grouped together, and sub-pixels in different groups do not overlap each other; in each group, all of the sub-pixels are electrically connected with a same data line; each row of the sub-pixels corresponds to two gate lines, and in each row of the sub-pixels, two sub-pixels belonging to the same group are electrically connected with one of the two gate lines corresponding to this row of the sub-pixels respectively.

In one possible implementation, in the array substrate provided in the embodiments of the present disclosure, in each row of the sub-pixels, odd columns of sub-pixels are electrically connected with gate lines above this row of the sub-pixels, and even columns of sub-pixels are electrically connected with gate lines below this row of the sub-pixels; or in each row of the sub-pixels, even columns of sub-pixels are electrically connected with gate lines above this row of the sub-pixels, and odd columns of sub-pixels are electrically connected with gate lines below this row of the sub-pixels.

Embodiments of the present disclosure further provide a display device comprising: the array substrate provided in the embodiments of the present disclosure.

With respect to the display device provided in the embodiments of the present disclosure, the embodiments of the present disclosure further provide an image display method, comprising:

when displaying one frame of image, loading a gray scale signal for each of the sub-pixels, so that each of the first sub-pixels displays a first gray scale, each of the second sub-pixels displays a second gray scale, each of the third sub-pixels displays a third gray scale, and each of the fourth sub-pixels displays a fourth gray scale; wherein, at least three of the first gray scale, the second gray scale, the third gray scale and the fourth gray scale are mutually different.

In one possible implementation, in the abovementioned method provided in the embodiments of the present disclosure, when the resistance color of the first sub-pixels is green, in one frame of display image, the first gray scale is less than the second gray scale and the third gray scale, and greater than the fourth gray scale.

In one possible implementation, in the abovementioned method provided in the embodiments of the present disclosure, in one frame of display image, the first gray scale is 127, the second gray scale and the third gray scale are 255, and the fourth gray scale is 0.

In one possible implementation, in the abovementioned method provided in the embodiments of the present disclosure, when the resistance color of the second sub-pixels is green, in one frame of display image, the second gray scale is greater than the first gray scale, and less than the third gray scale and the fourth gray scale.

In one possible implementation, in the abovementioned method provided in the embodiments of the present disclosure, in one frame of display image, the first gray scale is 0, the second gray scale is 127, and the third gray scale and the fourth gray scale are 255.

In one possible implementation, in the abovementioned method provided in the embodiments of the present disclosure, when the resistance color of the third sub-pixels is green, in one frame of display image, the third gray scale is less than the first gray scale and the fourth gray scale, and greater than the second gray scale.

In one possible implementation, in the abovementioned method provided in the embodiments of the present disclosure, in one frame of display image, the first gray scale and the fourth gray scale are 255, the second gray scale is 0, and the third gray scale is 127.

In one possible implementation, in the abovementioned method provided in the embodiments of the present disclosure, when the resistance color of the fourth sub-pixels is green, in one frame of display image, the fourth gray scale is less than the first gray scale and the second gray scale, and greater than the third gray scale.

In one possible implementation, in the abovementioned method provided in the embodiments of the present disclosure, in one frame of display image, the first gray scale and the second gray scale are 255, the third gray scale is 0, and the fourth gray scale is 127.

The abovementioned embodiments of the present disclosure provide the array substrate, the display device and the image display method. In the array substrate, among the sub-pixels two adjacent columns of sub-pixels are grouped together, and sub-pixels in different groups do not overlap each other; in each group, each sub-pixel is electrically connected with a same data line; each row of the sub-pixels corresponds to two gate lines, and in each row of the sub-pixels, two sub-pixels belonging to the same group are electrically connected with two gate lines corresponding to this row of the sub-pixels respectively; thus, in the process of sequentially loading a gate scanning signal to each grid line within the display time of one frame, charging difference between rows of sub-pixels caused by the jump of voltage loaded on the data line may be reduced, so that display luminance difference between rows of sub-pixels may be reduced, whereby poor stripes present when a flat panel display is displaying a screen may be improved.

DRAWINGS

The drawings described herein are for illustrative purposes only of selected embodiments and not all possible implementations, and are not intended to limit the scope of the present disclosure.

FIG. 4 is a schematic structural diagram of the array substrate in example 1 of the disclosure in;

Corresponding reference numerals indicate corresponding parts or features throughout the several views of the drawings.

DETAILED DESCRIPTION

Example embodiments will now be described more fully with reference to the accompanying drawings.

Figure 1:
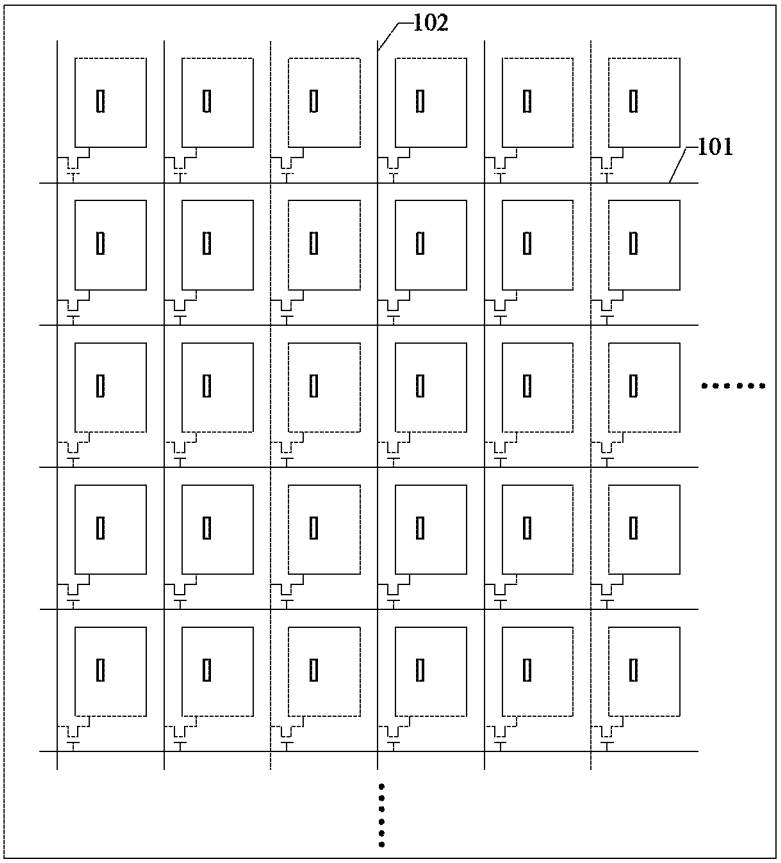
Figure 1 (Prior Art)
FIG. 1 is a schematic structural diagram of an array substrate in the prior art.
Figure 2:
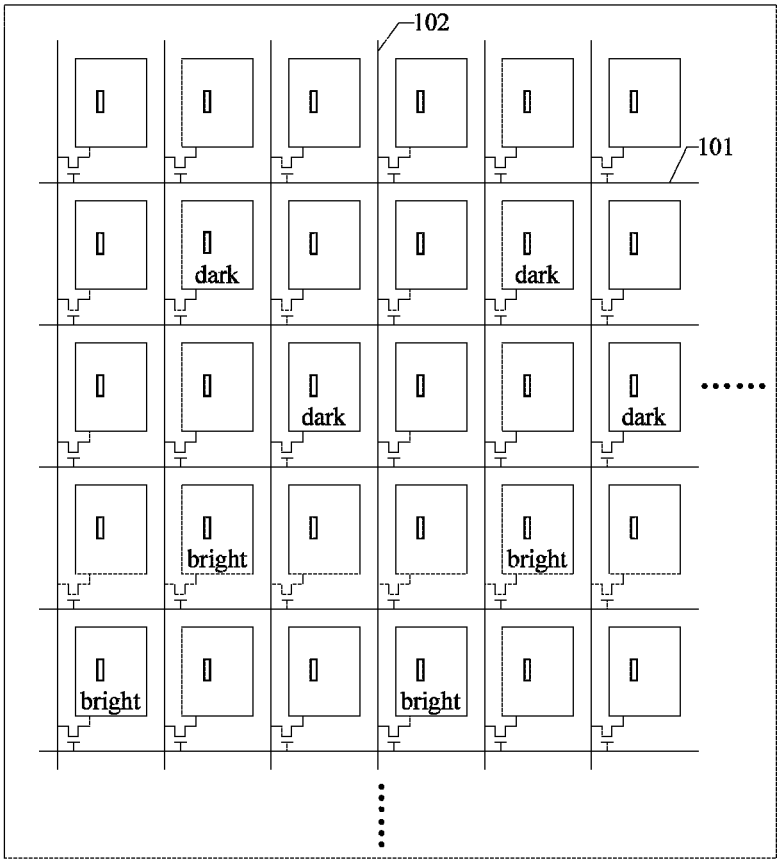
Figure 2 (Prior Art)
FIG. 2 is a schematic diagram of display luminance of sub-pixel I in an array substrate as shown in FIG. 1.

In an existing array substrate as shown in FIG. 1, the voltage of each of the sub-pixels in each row is a jump of the voltage of the sub-pixel in the upper row but in the same column. For example, the voltage of sub-pixel I in the second row of sub-pixels is a jump of the voltage of sub-pixel II in the first row of sub-pixels but in the same column as the sub-pixel I, the voltage of sub-pixel I in the third row of sub-pixels is a jump of the voltage of sub-pixel II in the second row of sub-pixels but in the same column as the sub-pixel I, the voltage of sub-pixel I in the fourth row of sub-pixels is a jump of the voltage of sub-pixel III in the third row of sub-pixels but in the same column as the sub-pixel I, and the voltage of sub-pixel I in the fifth row of sub-pixels is a jump of the voltage of sub-pixel III in the fourth row of sub-pixels but in the same column as the sub-pixel I. When the gray scale of sub-pixel I is greater than the gray scale of the sub-pixel II and the gray scale of the sub-pixel I is less than the gray scale of the sub-pixel III, the voltage of the sub-pixel I in the second and third rows of sub-pixels is a jump of the voltage of the sub-pixel II with a gray scale less than that of the sub-pixel I, and the voltage of the sub-pixel I in the fourth and fifth rows of sub-pixels is a jump of the voltage of the sub-pixel III with a gray scale greater than that of the sub-pixel I. Since the data line itself has certain electric resistance, within the same time, the sub-pixel I in the fourth and fifth rows of sub-pixels is charged more sufficiently than the sub-pixel I in the second and third rows of sub-pixels, so that in one frame of display image, as shown in FIG. 2, the display luminance of the sub-pixel I in the second and third rows of sub-pixels is less than the display luminance of the sub-pixel I in the fourth and fifth rows of sub-pixels; for the same reason, when the gray scale of sub-pixel I is less than the gray scale of the sub-pixel II and the gray scale of the sub-pixel I is greater than the gray scale of the sub-pixel III, in one frame of display image, the display luminance of the sub-pixel I in the second and third rows of sub-pixels is greater than the display luminance of the sub-pixel I in the fourth and fifth rows of sub-pixels; the difference between the display luminance of the sub-pixel I in the second and third rows of sub-pixels and the display luminance of the sub-pixel I in the fourth and fifth rows of sub-pixels will generate visually poor stripes.

Figure 3:
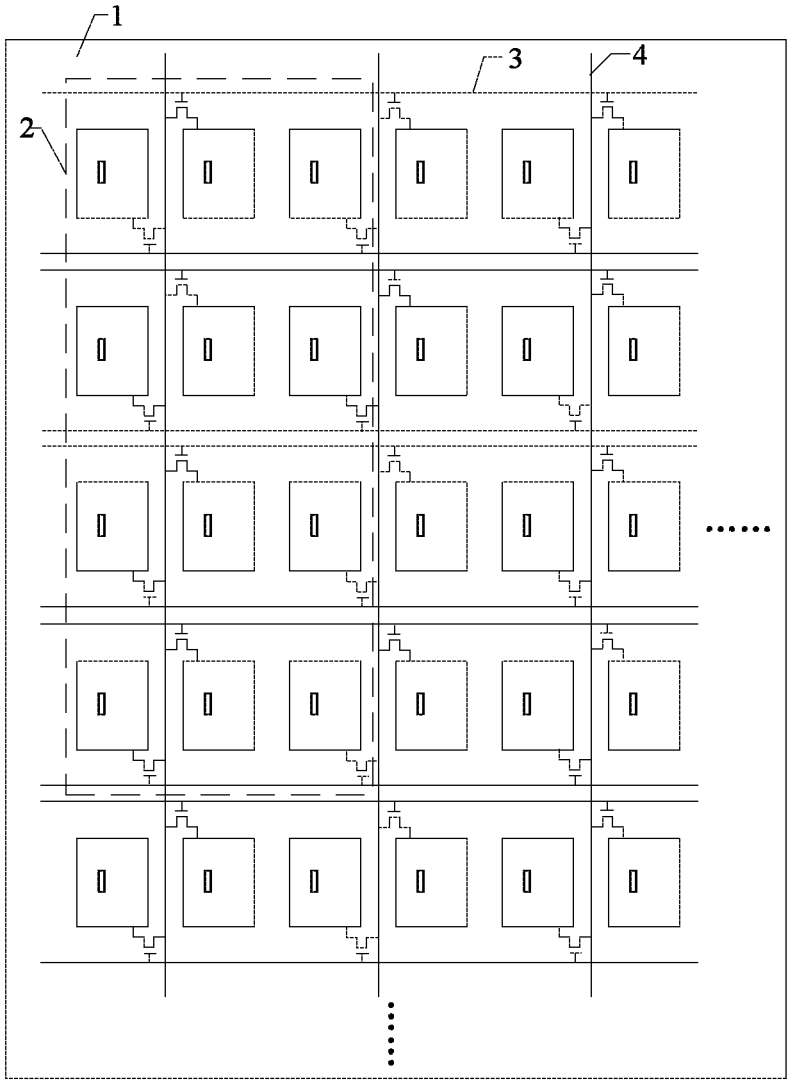
FIG. 3 is one schematic structural diagram of an array substrate provided in the embodiments of the disclosure.

On this basis, the present disclosure provides an array substrate in the embodiments. As shown in FIG. 3, the array substrate comprises: a base substrate 1 and a plurality of sub-pixel units 2 arranged in matrix on the base substrate 1; each sub-pixel unit 2 is composed of four rows and three columns of sub-pixels; in each sub-pixel unit 2, the first row is a first sub-pixel I, a second sub-pixel II and a third sub-pixel III sequentially, the second row is a third sub-pixel III, a first sub-pixel I and a second sub-pixel II sequentially, the third row is a second sub-pixel II, a third sub-pixel III and a first sub-pixel I sequentially, the fourth row of sub-pixels are the same as the second row of sub-pixels; the first sub-pixel I, the second sub-pixel II and the third sub-pixel III have resistance colors different from each other; I, II, III may represent any color in RGB. The array substrate further comprises: a plurality of gate lines 3 and a plurality of data lines 4 located on the base substrate 1, intersected and insulated one another.

Among the sub-pixels two adjacent columns of sub-pixels are grouped together, and sub-pixels in different groups do not overlap each other. In each group, all of the sub-pixels are electrically connected with a same data line. For example, as shown in FIG. 3, the first column of sub-pixels and the second column of sub-pixels are in the same group, and the first column of sub-pixels and the second column of sub-pixels are electrically connected with the data line 4 located between these two columns of sub-pixels; each row of the sub-pixels corresponds to two gate lines, and in each row of the sub-pixels, two sub-pixels belonging to the same group are electrically connected with one of the two gate lines corresponding to this row of the sub-pixels respectively. For example, as shown in FIG. 3, the first row of sub-pixels correspond to two gate lines 3, the two gate lines 3 being respectively located above and below the first row of sub-pixels, the pixel I in the first row and first column and the pixel I in the first row and second column belong to the same group, and are electrically connected with the gate line 3 below and above the first row of sub-pixels respectively.

In the array substrate provided in the embodiments of the present disclosure, among the sub-pixels, two adjacent columns of sub-pixels are grouped together, and in each group, all of the sub-pixels are electrically connected with a same data line; in each row of the sub-pixels, two sub-pixels belonging to the same group are electrically connected with two gate lines corresponding to this row of the sub-pixels respectively; thus, in the process of sequentially loading a gate scanning signal to each grid line within the display time of one frame, charging difference between rows of sub-pixels caused by the jump of voltage loaded on the data line may be reduced, so that display luminance difference between rows of sub-pixels may be reduced, whereby poor stripes present when a flat panel display is displaying a screen may be improved.

In specific applications, in the array substrate provided in the embodiments of the present disclosure, in each row of the sub-pixels, two sub-pixels belonging to the same group are electrically connected with one of the two gate lines corresponding to this row of the sub-pixels respectively. Specifically, in each row of the sub-pixels, odd columns of sub-pixels are electrically connected with gate lines above this row of the sub-pixels, and even columns of sub-pixels are electrically connected with gate lines below this row of the sub-pixels. Or, in each row of the sub-pixels, even columns of sub-pixels are electrically connected with gate lines above this row of the sub-pixels, and odd columns of sub-pixels are electrically connected with gate lines below this row of the sub-pixels (as shown in FIG. 3). There is no limitation thereon. The embodiments given below are all described based on the example that in each row of the sub-pixels, even columns of sub-pixels are electrically connected with gate lines above this row of the sub-pixels, and odd columns of sub-pixels are electrically connected with gate lines below this row of the sub-pixels.

Of course, in the array substrate provided in the embodiments of the present disclosure, two gate lines corresponding to each row of the sub-pixels are not limited to be located above and below this row of the sub-pixels respectively, and may also be located on the same side of this row of the sub-pixels, while it is not shown in the figure; and, in each row of the sub-pixels, two sub-pixels belonging to the same group are electrically connected with one of the two gate lines corresponding to this row of the sub-pixels respectively, but the connection way is not limited to that as shown in FIG. 3, and may be other similar connection way that may implement the present disclosure. There is no limitation thereon.

Based on the same inventive concept, embodiments of the present disclosure further provide a display device comprising the array substrate provided in the embodiments of the present disclosure. The display device may be: mobile phones, tablet computers, televisions, displays, laptops, digital photo frames, navigation systems and any product or part having display function. The implementation of the display device may refer to the embodiment of the array substrate, and the same parts will not be described any more.

Figure 11:
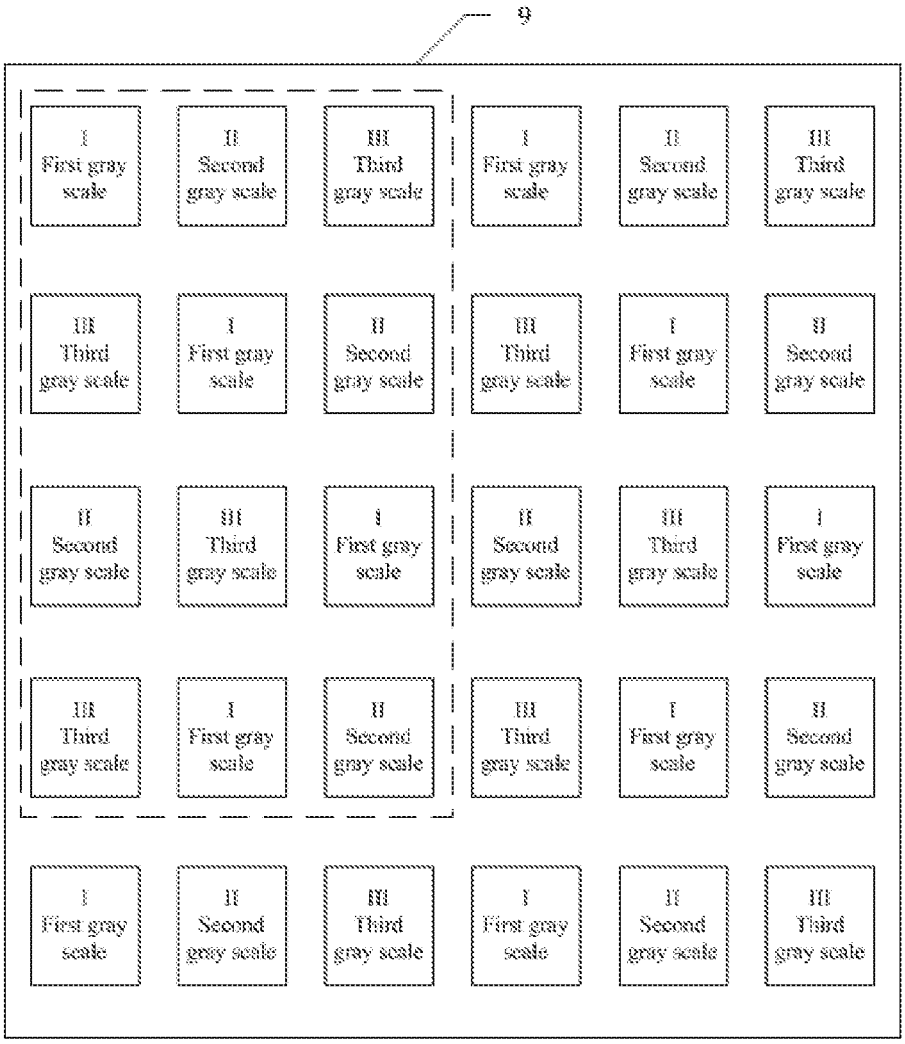
FIG. 11 is a schematic diagram of one frame of an image.

With respect to the display device provided in the embodiments of the present disclosure, the embodiments of the present disclosure further provide an image display method, comprising:

when displaying one frame of an image, loading a gray scale signal for each of the sub-pixels, so that each of the first sub-pixels displays a first gray scale, each of the second sub-pixels displays a second gray scale, and each of the third sub-pixels displays a third gray scale; wherein the first gray scale, the second gray scale and the third gray scale are mutually different. For example, FIG. 11 illustrates a schematic diagram of one frame of an image 9. As shown in FIG. 11, in one frame of the image 9, each first sub-pixel I displays the first gray scale, each second sub-pixel II displays the second gray scale, and each third sub-pixel III displays the third gray scale according to the loaded gray scale signal.

Since the human eye is sensitive to green, the specific mode to carry out the image display method provided in the embodiments of the present disclosure, when the resistance color of the first sub-pixel I, second sub-pixel II, and third sub-pixel III is green respectively, will be described below in detail by means of three specific examples.

Example 1

Figure 4:
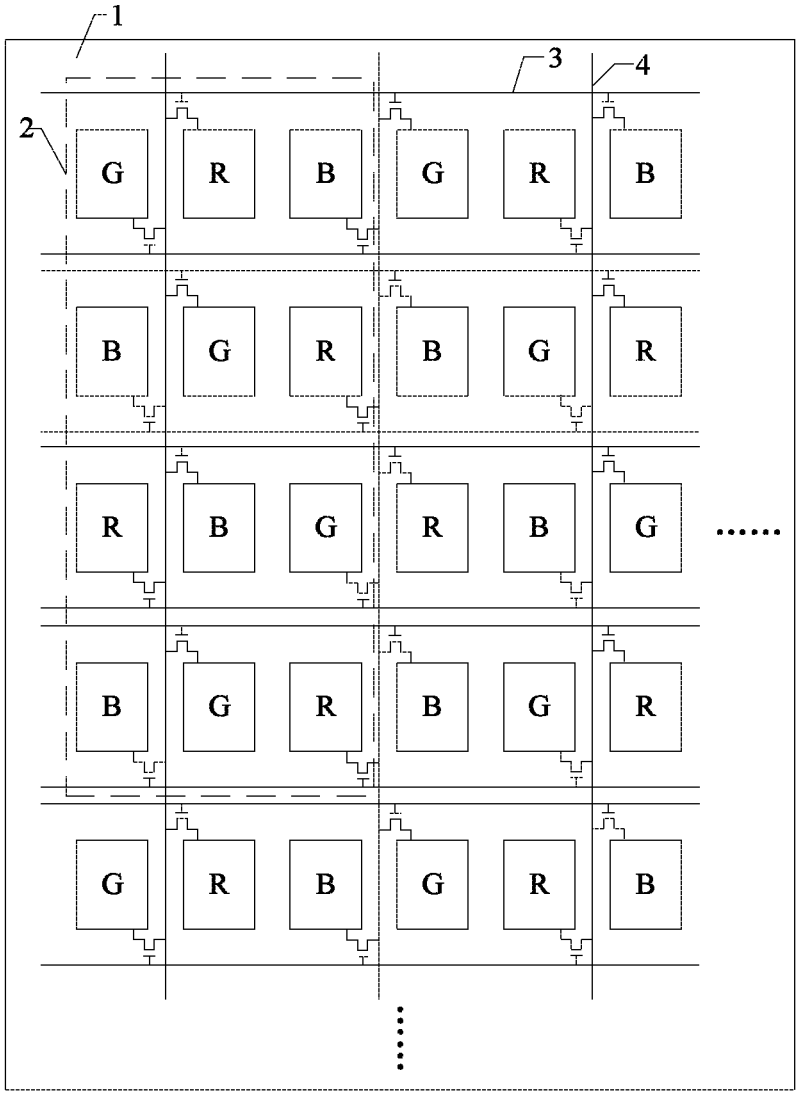

When resistance color of the first sub-pixel I is green (G), and resistance colors of the second sub-pixel II and of the third sub-pixel III are red (R) and blue (B), respectively, the arrangement of sub-pixels in the array substrate as shown in FIG. 3 corresponds to the arrangement as shown in FIG. 4. With respect to the display image in which the displayed first gray scale of the first sub-pixel I, i.e., sub-pixel G, is less than the displayed second gray scale of the second sub-pixel II, i.e. sub-pixel R, and the displayed first gray scale of the first sub-pixel I, i.e., sub-pixel G, is greater than the displayed third gray scale of the third sub-pixel III, i.e. sub-pixel B, the poor stripes may be improved.

As shown in FIG. 4, in the second row of sub-pixels, the voltage of sub-pixel G in the second column is a jump of the voltage of sub-pixel G in the first row and in the first column, the voltage of sub-pixel G in the fifth column is a jump of the voltage of sub-pixel R in the second row and in the sixth column. For the same reason, in the fourth row of sub-pixels, the voltage of sub-pixel G in the second column is a jump of the voltage of sub-pixel R in the third row and in the first column, the voltage of sub-pixel G in the fifth column is a jump of the voltage of sub-pixel R in the fourth row and in the sixth column. For the same reason, in the fifth row of sub-pixels, the voltage of sub-pixel G in the first column is a jump of the voltage of sub-pixel R in the fifth row and in the second column, the voltage of sub-pixel G in the fourth column is a jump of the voltage of sub-pixel R in the fourth row and in the third column.

Figure 5:
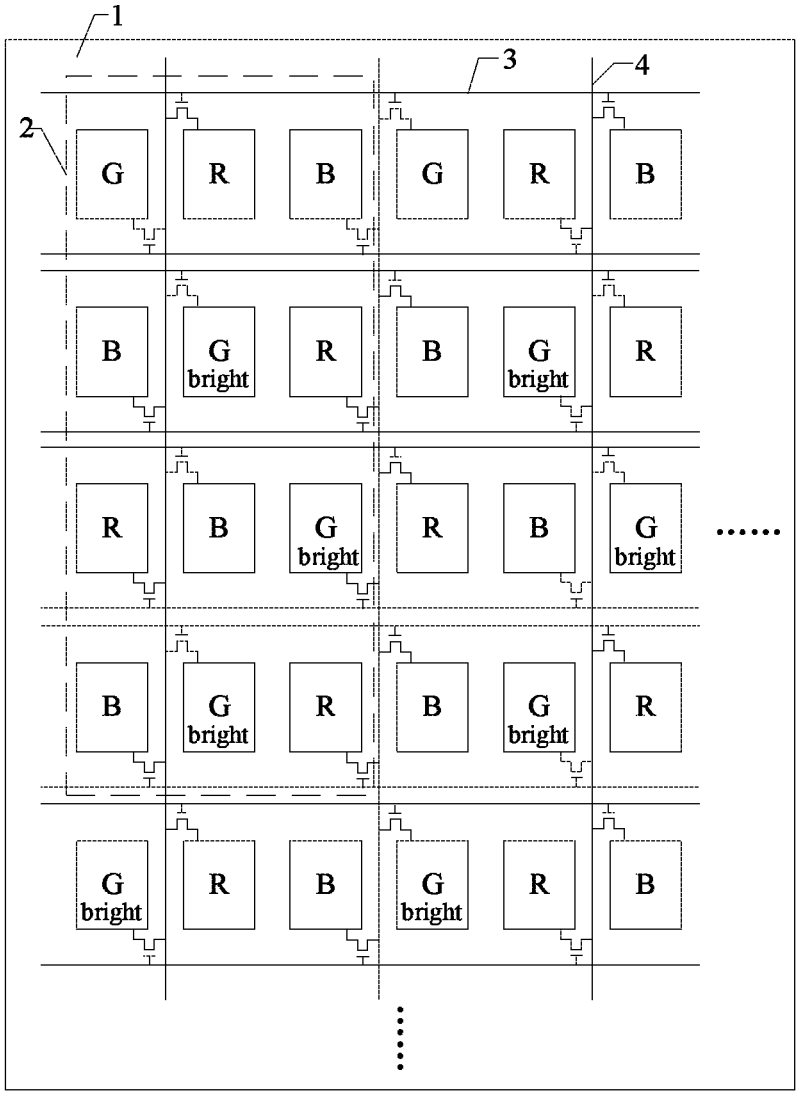
FIG. 5 is a schematic diagram of display luminance of sub-pixel G in an array substrate as shown in FIG. 4.

In summary, the voltage of one part of sub-pixel G in the second and third row of sub-pixels is a jump of the voltage of sub-pixel G, and the voltage of the other part of sub-pixel G in the second and third row of sub-pixels is a jump of the voltage of sub-pixel G, and the voltage of all the sub-pixel G in the fourth and fifth row of sub-pixels is a jump of the voltage of sub-pixel R. Since the displayed first gray scale of the sub-pixel G is less than the displayed second gray scale of the sub-pixel R, the charging status of the sub-pixel G obtained from a jump of the voltage of the sub-pixel G is substantially the same as the charging status of the sub-pixel G obtained from a jump of the voltage of the sub-pixel R, and the charging status of the sub-pixel G obtained from a jump of the voltage of the sub-pixel G is substantially the same as the charging status of the sub-pixel G obtained from a jump of the voltage of the sub-pixel R, whereby in one frame of display image, the display luminance of sub-pixel G in the second and third row of sub-pixels is substantially the same as the display luminance of sub-pixel G in the fourth and fifth row of sub-pixels (as shown in FIG. 5). Therefore, poor stripes may be significantly improved until the human eye cannot recognize them.

The description will be given below taking the gray scale of the display image of 0-255 as an example. Specially, when the displayed first gray scale of sub-pixel G is 127, the displayed second gray scale of sub-pixel R is 255, and the displayed third gray scale of sub-pixel B is 0, as shown in FIG. 1, the voltage of sub-pixel G in the second and third row of sub-pixels is a jump of sub-pixel B (B0→G127), and the voltage of sub-pixel G in the fourth and fifth row of sub-pixels is a jump of the voltage of sub-pixel R (R255→G127). Apparently, the sub-pixel G in the fourth and fifth row of sub-pixels is charged more sufficiently than the sub-pixel G in the second and third row of sub-pixels, whereby in one frame of display image, the display luminance of sub-pixel G in the second and third row of sub-pixels is obviously less than the display luminance of sub-pixel G in the fourth and fifth row of sub-pixels, and at the time, the difference between the display luminance of sub-pixel G in the second and third row of sub-pixels and the display luminance of sub-pixel G in the fourth and fifth row of sub-pixels is the biggest, with poorest stripes that can be recognized by the human eye. With respect to the display image in which the displayed first gray scale of sub-pixel G is 127, the displayed second gray scale of sub-pixel R is 255 and the displayed third gray scale of sub-pixel B is 0, and the effect of improvement of poor stripes is optimum.

Of course, when the resistance color of the first sub-pixel I is green (G), the resistance colors of the second sub-pixel I and third sub-pixel III may also be blue (B) and red (R) respectively, and the specific implementation thereof is similar to that in Example 1 and will not be described herein any more.

Figure 6:
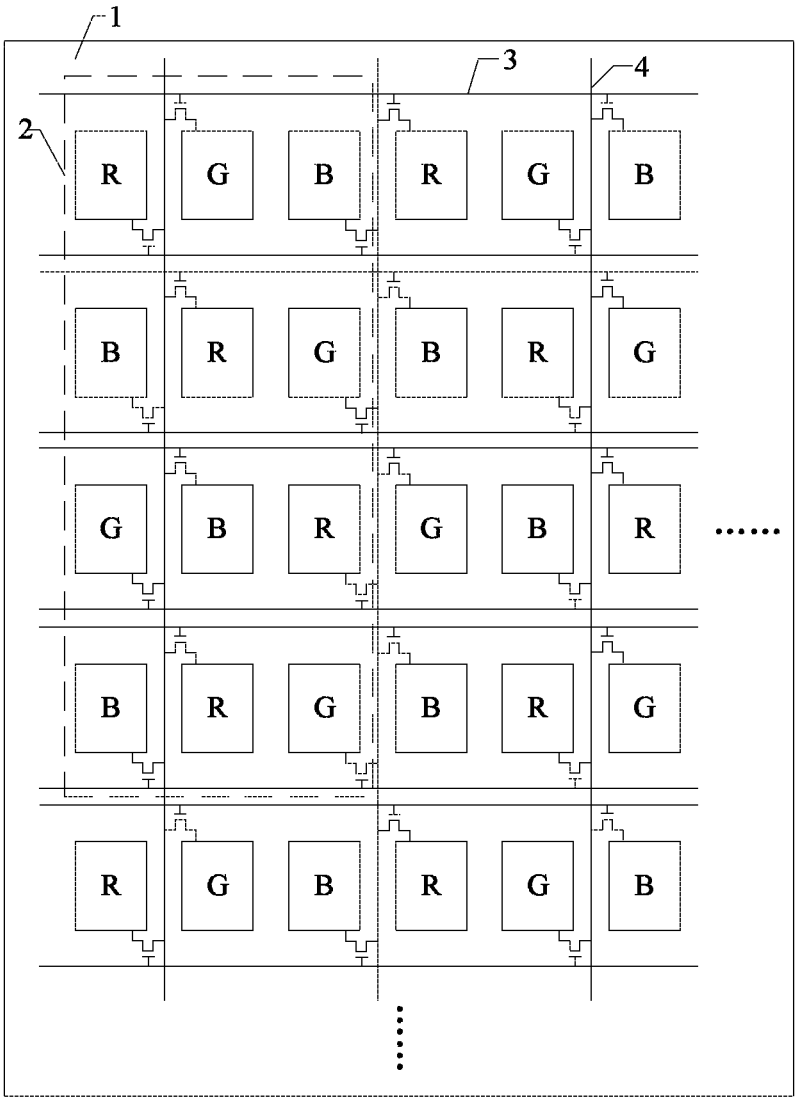
FIG. 6 is a schematic structural diagram of the array substrate in example 2 of the disclosure.

Example 2 resistance color of the second sub-pixel II is green (G), and resistance colors of the first sub-pixel I and of the third sub-pixel III are red (R) and blue (B), respectively, then the arrangement of sub-pixels in the array substrate as shown in FIG. 3 corresponds to the arrangement as shown in FIG. 6. With respect to the display image in which the displayed second gray scale of the second sub-pixel II, i.e., sub-pixel G, is greater than the displayed first gray scale of the first sub-pixel I, i.e. sub-pixel R, and the displayed second gray scale of the second sub-pixel II, i.e., sub-pixel G, is less than the displayed third gray scale of the third sub-pixel III, i.e. sub-pixel B, the poor stripes may be improved.

As shown in FIG. 6, in the second row of sub-pixels, the voltage of sub-pixel G in the third column is a jump of the voltage of sub-pixel G in the second row and in the fourth column, the voltage of sub-pixel G in the sixth column is a jump of the voltage of sub-pixel R in the first row and in the fifth column. For the same reason, in the third row of sub-pixels, the voltage of sub-pixel G in the first column is a jump of the voltage of sub-pixel B in the third row and in the second column, the voltage of sub-pixel G in the fourth column is a jump of the voltage of sub-pixel G in the second row and in the third column. For the same reason, in the fourth row of sub-pixels, the voltage of sub-pixel G in the sixth column is a jump of the voltage of sub-pixel B in the fourth row and in the fourth column, the voltage of sub-pixel G in the sixth column is a jump of the voltage of sub-pixel B in the third row and in the fifth column. For the same reason, in the fifth row of sub-pixels, the voltage of sub-pixel G in the second column is a jump of the voltage of sub-pixel B in the fourth row and in the first column, and the voltage of sub-pixel G in the fifth column is a jump of the voltage of sub-pixel B in the fifth row and in the sixth column.

Figure 7:
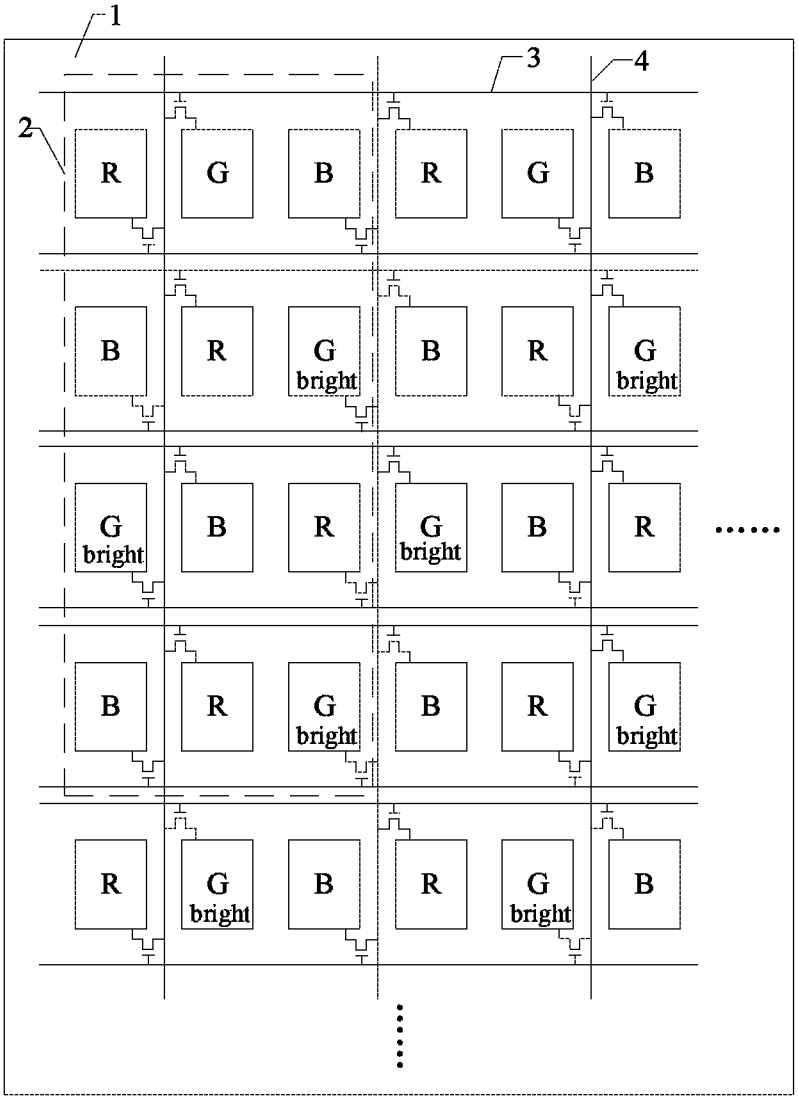
FIG. 7 is a schematic diagram of display luminance of sub-pixel G in an array substrate as shown in FIG. 6.

In summary, the voltage of one part of sub-pixel G in the second and third row of sub-pixels is a jump of the voltage of sub-pixel G, and the voltage of the other part of sub-pixel G in the second and third row of sub-pixels is a jump of the voltage of sub-pixel B, and the voltage of all the sub-pixel G in the fourth and fifth row of sub-pixels is a jump of the voltage of sub-pixel B. Since the displayed first gray scale of the sub-pixel G is less than the displayed second gray scale of the sub-pixel B, the charging status of the sub-pixel G obtained from a jump of the voltage of the sub-pixel G is substantially the same as the charging status of the sub-pixel G obtained from a jump of the voltage of the sub-pixel B. And, the display luminance of the sub-pixel G obtained from a jump of the voltage of the sub-pixel G is substantially the same as the display luminance of the sub-pixel G obtained from a jump of the voltage of the sub-pixel B, whereby in one frame of display image, the display luminance of sub-pixel G in the second and third row of sub-pixels is substantially the same as the display luminance of sub-pixel G in the fourth and fifth row of sub-pixels (as shown in FIG. 7). And, as compared with the case where the display luminance of sub-pixel G in the second and third row of sub-pixels is greater than the display luminance of sub-pixel G in the fourth and fifth row of sub-pixels, poor stripes may be significantly improved until the human eye cannot recognize them.

The description will be given below taking the gray scale of the display image of 0-255 as an example. Specially, when the displayed second gray scale of sub-pixel G is 127, the displayed first gray scale of sub-pixel R is 0, and the displayed third gray scale of sub-pixel B is 255, as shown in FIG. 1, the voltage of sub-pixel G in the second and third row of sub-pixels is a jump of sub-pixel B (B255→G127), and the voltage of sub-pixel G in the fourth and fifth row of sub-pixels is a jump of the voltage of sub-pixel R (R0→G127). Apparently, the sub-pixel G in the second and third row of sub-pixels is charged more sufficiently than the sub-pixel G in the fourth and fifth row of sub-pixels, whereby in one frame of display image, the display luminance of sub-pixel G in the second and third row of sub-pixels is obviously greater than the display luminance of sub-pixel G in the fourth and fifth row of sub-pixels. And, at the time, the difference between the display luminance of sub-pixel G in the second and third row of sub-pixels and the display luminance of sub-pixel G in the fourth and fifth row of sub-pixels is the biggest, with poorest stripes that can be recognized by the human eye. With respect to the display image in which the displayed second gray scale of sub-pixel G is 127, the displayed first gray scale of sub-pixel R is 0 and the displayed third gray scale of sub-pixel B is 255, and the effect of improvement of poor stripes is optimum.

Of course, when the resistance color of the second sub-pixel II is green (G), the resistance colors of the first sub-pixel I and third sub-pixel III may also be blue (B) and red (R) respectively, and the specific implementation thereof is similar to that in Example two and will not be described herein any more.

Example 3

Figure 8:
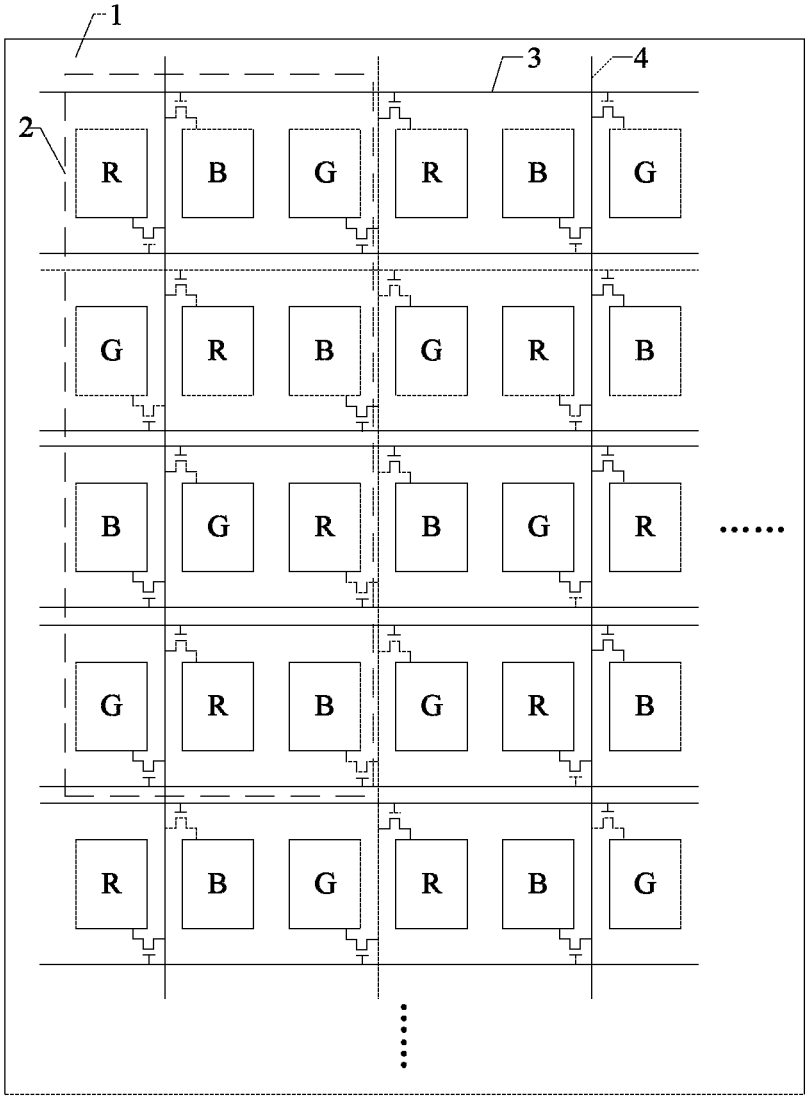
FIG. 8 is a schematic structural diagram of the array substrate in example 3 of the disclosure.

When resistance color of the third sub-pixel III is green (G), and resistance colors of the first sub-pixel I and of the second sub-pixel II are red (R) and blue (B), respectively, the arrangement of sub-pixels in the array substrate as shown in FIG. 3 corresponds to the arrangement as shown in FIG. 8. With respect to the display image in which the displayed third gray scale of the third sub-pixel III, i.e., sub-pixel G, is less than the displayed first gray scale of the first sub-pixel I, i.e. sub-pixel R, and the displayed third gray scale of the third sub-pixel III, i.e., sub-pixel G, is greater than the displayed second gray scale of the second sub-pixel II, i.e. sub-pixel B, the poor stripes may be improved.

As shown in FIG. 8, in the second row of sub-pixels, the voltage of sub-pixel G in the first column is a jump of the voltage of sub-pixel R in the second row and in the second column, the voltage of sub-pixel G in the fourth column is a jump of the voltage of sub-pixel G in the first row and in the third column. For the same reason, in the third row of sub-pixels, the voltage of sub-pixel G in the second column is a jump of the voltage of sub-pixel G in the second row and in the first column, the voltage of sub-pixel G in the fifth column is a jump of the voltage of sub-pixel R in the third row and in the sixth column. For the same reason, in the fourth row of sub-pixels, the voltage of sub-pixel G in the first column is a jump of the voltage of sub-pixel R in the fourth row and in the second column, the voltage of sub-pixel G in the fourth column is a jump of the voltage of sub-pixel R in the third row and in the third column. For the same reason, in the fifth row of sub-pixels, the voltage of sub-pixel G in the third column is a jump of the voltage of sub-pixel R in the fifth row and in the fourth column, and the voltage of sub-pixel G in the sixth column is a jump of the voltage of sub-pixel R in the fourth row and in the fifth column.

Figure 9:
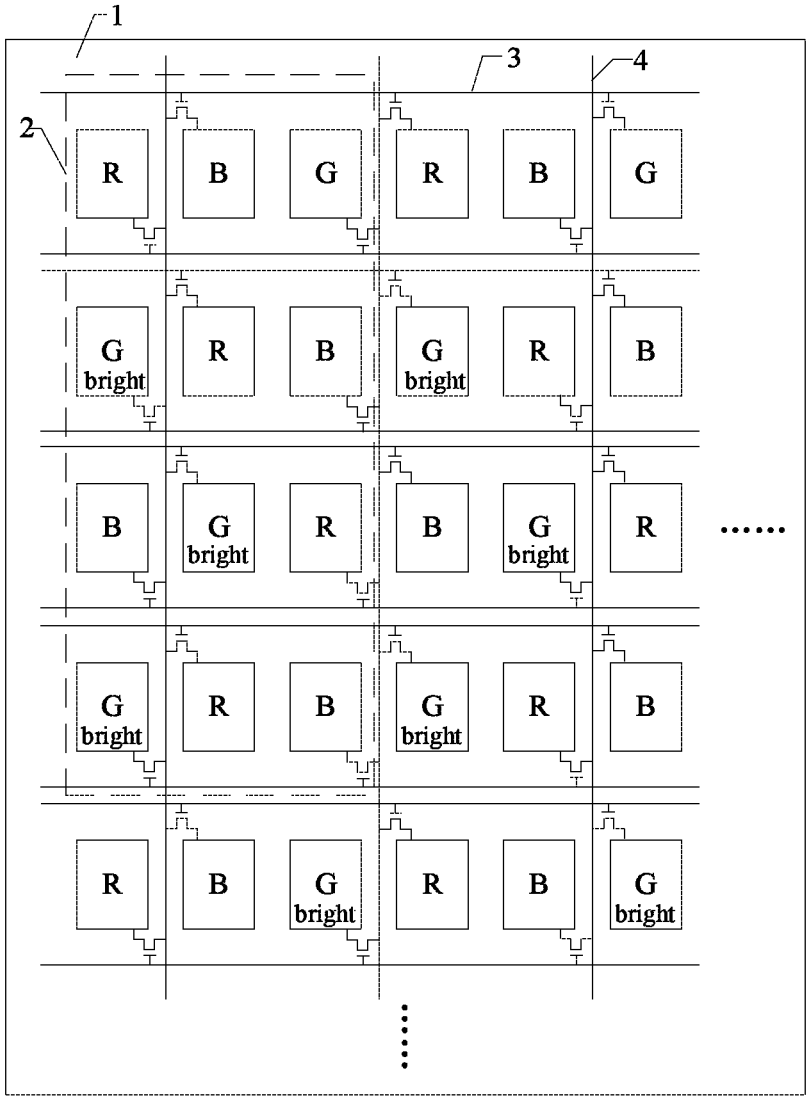
FIG. 9 is a schematic diagram of display luminance of sub-pixel G in an array substrate as shown in FIG. 8.

In summary, the voltage of one part of sub-pixel G in the second and third row of sub-pixels is a jump of the voltage of sub-pixel G, and the voltage of the other part of sub-pixel G in the second and third row of sub-pixels is a jump of the voltage of sub-pixel R, and the voltage of all the sub-pixel G in the fourth and fifth row of sub-pixels is a jump of the voltage of sub-pixel R. Since the displayed third gray scale of the sub-pixel G is less than the displayed first gray scale of the sub-pixel R, the charging status of the sub-pixel G obtained from a jump of the voltage of the sub-pixel G is substantially the same as the charging status of the sub-pixel G obtained from a jump of the voltage of the sub-pixel R. And the display luminance of the sub-pixel G obtained from a jump of the voltage of the sub-pixel G is substantially the same as the display luminance of the sub-pixel G obtained from a jump of the voltage of the sub-pixel R, whereby in one frame of display image, the display luminance of sub-pixel G in the second and third row of sub-pixels is substantially the same as the display luminance of sub-pixel G in the fourth and fifth row of sub-pixels (as shown in FIG. 9); and poor stripes may be significantly improved until the human eye cannot recognize them.

The description will be given below taking the gray scale of the display image of 0-255 as an example. Specially, when the displayed third gray scale of sub-pixel G is 127, the displayed first gray scale of sub-pixel R is 255, and the displayed second gray scale of sub-pixel B is 0, as shown in FIG. 1, the voltage of sub-pixel G in the second and third row of sub-pixels is a jump of sub-pixel B (B0→G127), and the voltage of sub-pixel G in the fourth and fifth row of sub-pixels is a jump of the voltage of sub-pixel R (R255→G127). Apparently, the sub-pixel G in the fourth and fifth row of sub-pixels is charged more sufficiently than the sub-pixel G in the second and third row of sub-pixels, whereby in one frame of display image, the display luminance of sub-pixel G in the second and third row of sub-pixels is obviously less than the display luminance of sub-pixel G in the fourth and fifth row of sub-pixels. And, at the time, the difference between the display luminance of sub-pixel G in the second and third row of sub-pixels and the display luminance of sub-pixel G in the fourth and fifth row of sub-pixels is the biggest, with poorest stripes that can be recognized by the human eye. With respect to the display image in which the displayed third gray scale of sub-pixel G is 127, the displayed first gray scale of sub-pixel R is 255 and the displayed second gray scale of sub-pixel B is 0, and the effect of improvement of poor stripes is optimum.

Of course, when the resistance color of the third sub-pixel III is green (G), the resistance colors of the first sub-pixel I and second sub-pixel II may also be blue (B) and red (R) respectively, and the specific implementation thereof is similar to that in Example 2 and will not be described herein any more.

Figure 10:
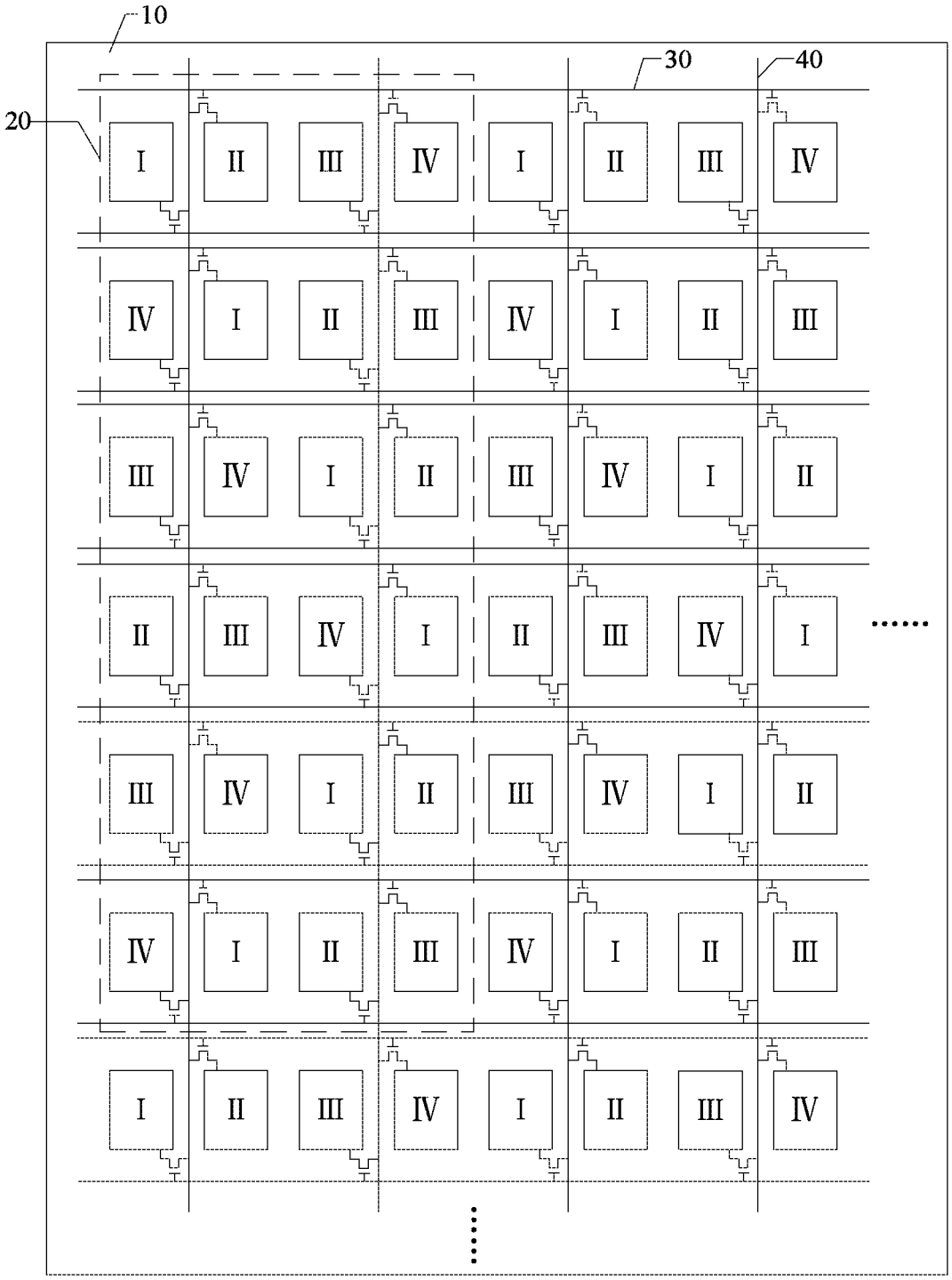
FIG. 10 is another schematic structural diagram of an array substrate provided in the embodiments of the disclosure.

Based on the same inventive concept, the embodiments of the disclosure further provide an array substrate. as shown in FIG. 10, the array substrate comprises: a base substrate 10 and a plurality of sub-pixel units 20 arranged in matrix on the base substrate 10; each of the sub-pixel units 20 is composed of six rows and four columns of sub-pixels; in each of the sub-pixel units 20, the first row is a first sub-pixel I, a second sub-pixel II, a third sub-pixel III and a fourth sub-pixel IV sequentially, the second row is a fourth sub-pixel IV, a first sub-pixel I, a second sub-pixel II and a third sub-pixel III sequentially, the third row is a third sub-pixel III, a fourth sub-pixel IV, a first sub-pixel I and a second sub-pixel II sequentially; the fourth row is a second sub-pixel II, a third sub-pixel III, a fourth sub-pixel IV and a first sub-pixel I sequentially; the fifth row of sub-pixels are the same as the third row of sub-pixels; the sixth row of sub-pixels are the same as the second row of sub-pixels; the first sub-pixel I, the second sub-pixel II, the third sub-pixel III and the fourth sub-pixel IV have resistance colors different from each other; I, II, III, IV may represent any of red (R), green (G), blue (B) and white (W), or also may represent any of red (R), green (G), blue (B) and white (Y), etc. The array substrate further comprises: a plurality of gate lines 30 and a plurality of data lines 40 located on the base substrate 10, intersected and insulated one another;

among the sub-pixels two adjacent columns of sub-pixels are grouped together, and sub-pixels in different groups do not overlap each other. Wherein, in each group, each sub-pixel is electrically connected with a same data line. For example, as shown in FIG. 10, the first column of sub-pixels and the second column of sub-pixels are grouped together, and both the first column of sub-pixels and the second column of sub-pixels are electrically connected with a data line 40 between the two columns of sub-pixels; each row of the sub-pixels corresponds to two gate lines, and in each row of the sub-pixels, two sub-pixels belonging to the same group are electrically connected with one of the two gate lines corresponding to this row of the sub-pixels respectively. For example, as shown in FIG. 10, the first row of sub-pixels corresponds to two gate lines 30, and the two gate lines 30 are located above and below the first row of sub-pixels respectively. The sub-pixel I in the first row and in the first column and the sub-pixel II in the first row and in the second column belong to the same group and are electrically connected with gate lines 30 located below and above the first row of sub-pixels respectively.

In the array substrate provided in the embodiments of the present disclosure, among the sub-pixels, two adjacent columns of sub-pixels are grouped together, all of the sub-pixels in each group are electrically connected with a same data line, and in each row of sub-pixels two sub-pixels belonging to the same group are electrically connected with two gate lines corresponding to this row of sub-pixels respectively, so that in the process of loading a gate scanning signal to each gate line sequentially in the display time of one frame, the charging difference among rows of sub-pixels caused by a jump of voltage loaded on the data line may be reduced, and whereby the display luminance difference among rows of sub-pixels may be reduced and further poor stripes present when the flat display is displaying the screen.

In specific implementations, in the array substrate provided in the embodiments of the present disclosure, in each row of sub-pixels, two sub-pixels belonging to the same group are electrically connected with two gate lines corresponding to this row of sub-pixels respectively. Specifically, it may be that in each row of sub-pixels, odd columns of sub-pixels are electrically connected with gate lines above this row of the sub-pixels, and even columns of sub-pixels are electrically connected with gate lines below this row of the sub-pixels; or it also may be that in each row of the sub-pixels, even columns of sub-pixels are electrically connected with gate lines above this row of the sub-pixels, and odd columns of sub-pixels are electrically connected with gate lines below this row of the sub-pixels (as shown in FIG. 10). This will not be defined herein any more.

Of course, in the array substrate provided in the embodiments of the present disclosure, two gate lines corresponding to each row of the sub-pixels are not limited to be located above and below this row of the sub-pixels respectively as shown in FIG. 10, and may also be located on the same side of this row of the sub-pixels, while it is not shown in the figure. And, in each row of the sub-pixels, two sub-pixels belonging to the same group are electrically connected with two gate lines corresponding to this row of the sub-pixels respectively, but the connection way is not limited to that as shown in FIG. 10, and may also be other similar connection way that may implement the present disclosure. There is no limitation thereon.

Based on the same inventive concept, embodiments of the present disclosure further provide a display device comprising the array substrate provided in the embodiments of the present disclosure. The display device may be: mobile phones, tablet computers, televisions, displays, laptops, digital photo frames, navigation systems and any product or part having display function. The implementation of the display device may refer to the embodiment of the array substrate, and the same parts will not be described any more.

With respect to the display device provided in the embodiments of the present disclosure, the embodiments of the present disclosure further provide an image display method, comprising:

when displaying one frame of image, loading a gray scale signal for each of the sub-pixels, so that each of the first sub-pixels displays a first gray scale, each of the second sub-pixels displays a second gray scale, each of the third sub-pixels displays a third gray scale, and each of the fourth sub-pixels displays a fourth gray scale; wherein, at least three of the first gray scale, the second gray scale, the third gray scale and the fourth gray scale are mutually different.

Since the human eye is sensitive to green, the specific mode to carry out the image display method provided in the embodiments of the present disclosure, when the resistance color of the first sub-pixel I, second sub-pixel II, third sub-pixel III and fourth sub-pixel IV is green respectively, will be described below, and its specific implementation is similar to that when the resistance color of the first sub-pixel I, second sub-pixel II, and third sub-pixel III as shown in FIG. 4-FIG. 9 is green respectively, and the repetitive parts will not be described any more herein.

In specific implementation, in the abovementioned method provided in the embodiments of the present disclosure, when the resistance color of the first sub-pixels is green, with respect to the display image in which the first gray scale is less than the second and third gray scale and the first gray scale is greater than the fourth gray scale, poor stripes may be improved.

When the gray scale of one frame of display image is 0-255, specially, with respect to the display image in which the first gray scale is 127, the second and third gray scale is 255, and the fourth gray scale is 0, the effect of improvement of poor stripes is optimum.

In specific implementation, in the abovementioned method provided in the embodiments of the present disclosure, when the resistance color of the second sub-pixels is green, with respect to the display image in which the second gray scale is greater than the first gray scale, and less than the third gray scale and the fourth gray scale, poor stripes may be improved.

When the gray scale of one frame of display image is 0-255, specially, with respect to the display image in which the first gray scale is 0, the second gray scale is 127, and the third gray scale and the fourth gray scale are 255, the effect of improvement of poor stripes is optimum.

In specific implementation, in the abovementioned method provided in the embodiments of the present disclosure, when the resistance color of the third sub-pixels is green, with respect to the display image in which the third gray scale is less than the first gray scale and the fourth gray scale, and greater than the second gray scale, poor stripes may be improved.

When the gray scale of one frame of display image is 0-255, specially, with respect to the display image in which the first gray scale and the fourth gray scale are 255, the second gray scale is 0, and the third gray scale is 127, the effect of improvement of poor stripes is optimum.

In specific implementation, in the abovementioned method provided in the embodiments of the present disclosure, when the resistance color of the fourth sub-pixels is green, in one frame of display image, the fourth gray scale is less than the first gray scale and the second gray scale, and greater than the third gray scale, poor stripes may be improved.

When the gray scale of one frame of display image is 0-255, specially, in one frame of display image in which the first gray scale and the second gray scale are 255, the third gray scale is 0, and the fourth gray scale is 127, the effect of improvement of poor stripes is optimum.

The abovementioned embodiments of the present disclosure provide the array substrate, the display device and the image display method. In the array substrate, among the sub-pixels two adjacent columns of sub-pixels are grouped together, and sub-pixels in different groups do not overlap each other. In each group, all of the sub-pixels are electrically connected with a same data line. Each row of the sub-pixels corresponds to two gate lines, and in each row of the sub-pixels, two sub-pixels belonging to the same group are electrically connected with two gate lines corresponding to this row of the sub-pixels respectively. Thus, in the process of sequentially loading a gate scanning signal to each grid line within the display time of one frame, charging difference between rows of sub-pixels caused by the jump of voltage loaded on the data line may be reduced, so that display luminance difference between rows of sub-pixels may be reduced, whereby poor stripes present when a flat panel display is displaying a screen may be improved.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. An array substrate, comprising: a base substrate and a plurality of sub-pixel units arranged in matrix on the base substrate; each of the sub-pixel units is composed of four rows and three columns of sub-pixels; in each of the sub-pixel units, the first row is a first sub-pixel, a second sub-pixel and a third sub-pixel sequentially, the second row is a third sub-pixel, a first sub-pixel and a second sub-pixel sequentially, the third row is a second sub-pixel, a third sub-pixel and a first sub-pixel sequentially, and the fourth row of sub-pixels are the same as the second row of sub-pixels; the first sub-pixel, the second sub-pixel and the third sub-pixel have resistance colors different from each other;

further comprising: a plurality of gate lines and a plurality of data lines located on the base substrate, the plurality of gate lines and the plurality of data lines intersecting and insulated from one another;

wherein among the sub-pixels, two adjacent columns of sub-pixels are grouped together, and sub-pixels in different groups do not overlap each other; in each group, all of the sub-pixels are electrically connected with a same data line; each row of the sub-pixels corresponds to two gate lines, and in each row of the sub-pixels, two sub-pixels belonging to the same group are electrically connected with one of the two gate lines corresponding to this row.

2. The array substrate according to claim 1, wherein in each row of the sub-pixels, odd columns of sub-pixels are electrically connected with gate lines above this row of the sub-pixels, and even columns of sub-pixels are electrically connected with gate lines below this row of the sub-pixels; or, wherein in each row of the sub-pixels, even columns of sub-pixels are electrically connected with gate lines above this row of the sub-pixels, and odd columns of sub-pixels are electrically connected with gate lines below this row of the sub-pixel.

3. A display device comprising:

an array substrate comprising a base substrate, a plurality of sub-pixel units arranged in matrix on the base substrate, a plurality of gate lines, and a plurality of data lines, the plurality of gate lines and the plurality of data lines located on the base substrate, the plurality of gate lines and the plurality of data lines intersecting and insulated from one another;

wherein each of the sub-pixel units is composed of four rows and three columns of sub-pixels; in each of the sub-pixel units, the first row is a first sub-pixel, a second sub-pixel and a third sub-pixel sequentially, the second row is a third sub-pixel, a first sub-pixel and a second sub-pixel sequentially, the third row is a second sub-pixel, a third sub-pixel and a first sub-pixel sequentially, and the fourth row of sub-pixels are the same as the second row of sub-pixels; the first sub-pixel, the second sub-pixel and the third sub-pixel have resistance colors different from each other; and wherein among the sub-pixels two adjacent columns of sub-pixels are grouped together, and sub-pixels in different groups do not overlap each other; in each group, all of the sub-pixels are electrically connected with a same data line; each row of the sub-pixels corresponds to two gate lines, and in each row of the sub-pixels, two sub-pixels belonging to the same group are electrically connected with one of the two gate lines corresponding to this row.

4. An image display method of a display device, the display device comprising an array substrate having a base substrate, a plurality of sub-pixel units arranged in matrix on the base substrate, a plurality of gate lines, and a plurality of data lines, the plurality of gate lines and the plurality of data lines located on the base substrate, the plurality of gate lines and the plurality of data lines intersecting and insulated from one another; each of the sub-pixel units composed of four rows and three columns of sub-pixels, wherein in each of the sub-pixel units, the first row is a first sub-pixel, a second sub-pixel and a third sub-pixel sequentially, the second row is a third sub-pixel, a first sub-pixel and a second sub-pixel sequentially, the third row is a second sub-pixel, a third sub-pixel and a first sub-pixel sequentially, and the fourth row of sub-pixels are the same as the second row of sub-pixels, the first sub-pixel, the second sub-pixel and the third sub-pixel having resistance colors different from each other, and wherein among the sub-pixels two adjacent columns of sub-pixels are grouped together, and sub-pixels in different groups do not overlap each other; in each group, all of the sub-pixels are electrically connected with a same data line; each row of the sub-pixels corresponds to two gate lines, and in each row of the sub-pixels, two sub-pixels belonging to the same group are electrically connected with one of the two gate lines corresponding to this row, the method comprising when displaying one frame of an image, loading a gray scale signal for each of the sub-pixels, so that each of the first sub-pixels displays a first gray scale, each of the second sub-pixels displays a second gray scale, and each of the third sub-pixels displays a third gray scale; wherein the first gray scale, the second gray scale and the third gray scale are mutually different.

5. The method according to claim 4, wherein when the resistance color of the first sub-pixels is green, in one frame of a display image, the first gray scale is less than the second gray scale, and greater than the third gray scale.

6. The method according to claim 5, wherein in one frame of the display image, the first gray scale is 127, the second gray scale is 255, and the third gray scale is 0.

7. The method according to claim 4, wherein when the resistance color of the second sub-pixels is green, in one frame of a display image, the second gray scale is greater than the first gray scale, and less than the third gray scale.

8. The method according to claim 7, wherein in one frame of the display image, the first gray scale is 0, the second gray scale is 127, and the third gray scale is 255.

9. The method according to claim 4, wherein when the resistance color of the third sub-pixels is green, in one frame of a display image, the third gray scale is less than the first gray scale, and greater than the second gray scale.

10. The method according to claim 9, wherein in one frame of the display image, the first gray scale is 255, the second gray scale is 0, and the third gray scale is 127.

11. An array substrate, comprising: a base substrate and a plurality of sub-pixel units arranged in matrix on the base substrate; each of the sub-pixel units is composed of six rows and four columns of sub-pixels; in each of the sub-pixel units, the first row is a first sub-pixel, a second sub-pixel, a third sub-pixel and a fourth sub-pixel sequentially, the second row is a fourth sub-pixel, a first sub-pixel, a second sub-pixel and a third sub-pixel sequentially, the third row is a third sub-pixel, a fourth sub-pixel, a first sub-pixel and a second sub-pixel sequentially, the fourth row is a second sub-pixel, a third sub-pixel, a fourth sub-pixel and a first sub-pixel sequentially, the fifth row of sub-pixels are the same as the third row of sub-pixels, and the sixth row of sub-pixels are the same as the second row of sub-pixels; the first sub-pixel, the second sub-pixel, the third sub-pixel and the fourth sub-pixel have resistance colors different from each other; further comprising: a plurality of gate lines and a plurality of data lines located on the base substrate, the plurality of gate lines and the plurality of data lines intersecting and insulated from one another; wherein among the sub-pixels, two adjacent columns of sub-pixels are grouped together, and sub-pixels in different groups do not overlap each other; in each group, all of the sub-pixels are electrically connected with a same data line; each row of the sub-pixels corresponds to two gate lines, and in each row of the sub-pixels, two sub-pixels belonging to the same group are electrically connected with one of the two gate lines corresponding to this row.

12. The array substrate according to claim 11, wherein in each row of the sub-pixels, odd columns of sub-pixels are electrically connected with gate lines above this row of the sub-pixels, and even columns of sub-pixels are electrically connected with gate lines below this row of the sub-pixels; or, in each row of the sub-pixels, even columns of sub-pixels are electrically connected with gate lines above this row of the sub-pixels, and odd columns of sub-pixels are electrically connected with gate lines below this row of the sub-pixel.

13. A display device comprising:

an array substrate comprising a base substrate, a plurality of sub-pixel units arranged in matrix on the base substrate, a plurality of gate lines, and a plurality of data lines, the plurality of gate lines and the plurality of data lines located on the base substrate, the plurality of gate lines and the plurality of data lines intersecting and insulated from one another, each of the sub-pixel units composed of six rows and four columns of sub-pixels;

wherein in each of the sub-pixel units, the first row is a first sub-pixel, a second sub-pixel, a third sub-pixel and a fourth sub-pixel sequentially, the second row is a fourth sub-pixel, a first sub-pixel, a second sub-pixel and a third sub-pixel sequentially, the third row is a third sub-pixel, a fourth sub-pixel, a first sub-pixel and a second sub-pixel sequentially, the fourth row is a second sub-pixel, a third sub-pixel, a fourth sub-pixel and a first sub-pixel sequentially, the fifth row of sub-pixels are the same as the third row of sub-pixels, and the sixth row of sub-pixels are the same as the second row of sub-pixels; the first sub-pixel, the second sub-pixel, the third sub-pixel and the fourth sub-pixel have resistance colors different from each other; and wherein among the sub-pixels two adjacent columns of sub-pixels are grouped together, and sub-pixels in different groups do not overlap each other; in each group, all of the sub-pixels are electrically connected with a same data line; each row of the sub-pixels corresponds to two gate lines, and in each row of the sub-pixels, two sub-pixels belonging to the same group are electrically connected with one of the two gate lines corresponding to this row.

14. An image display method of the display device, the display device comprising an array substrate having a base substrate, a plurality of sub-pixel units arranged in matrix on the base substrate, a plurality of gate lines and a plurality of data lines, the plurality of gate lines and the plurality of data lines located on the base substrate, the plurality of gate lines and the plurality of data lines intersecting and insulated from one another; each of the sub-pixel units composed of six rows and four columns of sub-pixels;

wherein in each of the sub-pixel units, the first row is a first sub-pixel, a second sub-pixel, a third sub-pixel and a fourth sub-pixel sequentially, the second row is a fourth sub-pixel, a first sub-pixel, a second sub-pixel and a third sub-pixel sequentially, the third row is a third sub-pixel, a fourth sub-pixel, a first sub-pixel and a second sub-pixel sequentially, the fourth row is a second sub-pixel, a third sub-pixel, a fourth sub-pixel and a first sub-pixel sequentially, the fifth row of sub-pixels are the same as the third row of sub-pixels, and the sixth row of sub-pixels are the same as the second row of sub-pixels; the first sub-pixel, the second sub-pixel, the third sub-pixel and the fourth sub-pixel have resistance colors different from each other, and wherein among the sub-pixels two adjacent columns of sub-pixels are grouped together, and sub-pixels in different groups do not overlap each other; in each group, all of the sub-pixels are electrically connected with a same data line; each row of the sub-pixels corresponds to two gate lines, and in each row of the sub-pixels, two sub-pixels belonging to the same group are electrically connected with one of the two gate lines corresponding to this row, the method comprising when displaying one frame of an image, loading a gray scale signal for each of the sub-pixels, so that each of the first sub-pixels displays a first gray scale, each of the second sub-pixels displays a second gray scale, each of the third sub-pixels displays a third gray scale, and each of the fourth sub-pixels displays a fourth gray scale; wherein at least three of the first gray scale, the second gray scale, the third gray scale and the fourth gray scale are mutually different.

15. The method according to claim 14, wherein when the resistance color of the first sub-pixels is green, in one frame of a display image, the first gray scale is less than the second gray scale and the third gray scale, and greater than the fourth gray scale.

16. The method according to claim 15, wherein in one frame of the display image, the first gray scale is 127, the second gray scale and the third gray scale are 255, and the fourth gray scale is 0.

17. The method according to claim 14, wherein when the resistance color of the second sub-pixels is green, in one frame of a display image, the second gray scale is greater than the first gray scale, and less than the third gray scale and the fourth gray scale.

18. The method according to claim 17, wherein in one frame of the display image, the first gray scale is 0, the second gray scale is 127, and the third gray scale and the fourth gray scale are 255.

19. The method according to claim 14, wherein when the resistance color of the third sub-pixels is green, in one frame of a display image, the third gray scale is less than the first gray scale and the fourth gray scale, and greater than the second gray scale.

20. The method according to claim 19, wherein in one frame of the display image, the first gray scale and the fourth gray scale are 255, the second gray scale is 0, and the third gray scale is 127.

* * * * *